United States Patent [19]

Travor et al.

[11] 3,972,287

[45] Aug. 3, 1976

[54] CARTRIDGE

[75] Inventors: Bruce W. Travor, Holland, Pa.; Lennord L. Pitney, Park Rapids, Minn.

[73] Assignee: The United States of America as represented by the Secretary of the Army, Washington, D.C.

[22] Filed: Nov. 15, 1974

[21] Appl. No.: 524,289

[52] U.S. Cl. ..... 102/39; 60/632; 102/27 R; 102/70 R

[51] Int. Cl.[2] ..... F42B 3/04

[58] Field of Search ..... 102/38, 39, 40, 90, 102/27, 70; 89/1 B; 60/632–638; 280/150 AB

[56] References Cited

UNITED STATES PATENTS

| | | | |
|---|---|---|---|
| 2,514,422 | 7/1950 | Simpson | 89/179 UX |
| 2,869,463 | 1/1959 | McKnight | 102/39 |
| 2,921,521 | 1/1960 | La Haye et al. | 102/39 |
| 3,289,583 | 12/1966 | Silverman | 102/20 |
| 3,301,183 | 1/1967 | Hennessy et al. | 102/27 R |
| 3,336,869 | 8/1967 | Peterson et al. | 102/27 |
| 3,762,267 | 10/1973 | Travor et al. | 102/27 R X |

*Primary Examiner*—Harold Tudor
*Attorney, Agent, or Firm*—Nathan Edelberg; Robert P. Gibson; William Sommer

[57] ABSTRACT

A gas generating cartridge case having a close tolerance delay ignition unit intermediate ignition train elements and which functions with reliable accuracy and is insensitive to large temperature variations or extremes. An aluminum cartridge case, carrying a gas generating charge, has a retainer secured in its rearward end. The retainer has a base portion containing a percussion primer and a cylindrical sidewall portion containing the delay ignition unit that includes a spool having ignition train elements in its end flanges and a burnable fuze delay wire secured to the spool flanges and interconnecting the ignition train elements. The spool and retainer base portion are longitudinally spaced to provide a cavity therebetween for precluding primer overpressurization.

3 Claims, 1 Drawing Figure

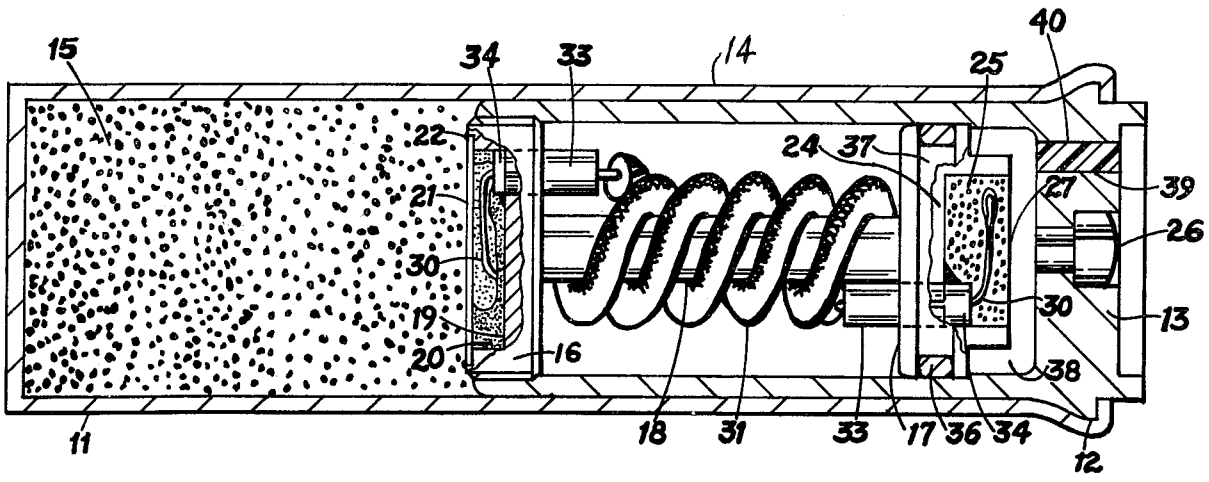
39
26
13
12
40
27
30
38
34
25
36
17
37
33
24
14
31
18
33
16
34
22
21
30
19
20
15
11

CARTRIDGE

The invention described herein may be manufactured, used and licensed by or for the Government for governmental purposes without the payment to us of any royalty thereon.

This invention relates to cartridges, and more particularly to a gas generating cartridge case.

It is an object of the invention to provide a gas generating cartridge case having a close tolerance delay ignition unit which functions with reliable accuracy.

Another object of the invention is to provide such a cartridge case in which the delay unit is insensitive to large temperature variations or extremes.

A further object of the invention is to provide such a cartridge case in which overpressurization by the primer is precluded.

These and further objects, features and advantages will become more apparent from the following description and accompanying drawing in which the sole figure is a longitudinal sectional view of a cartridge case embodying the principles of the invention.

The gas generating cartridge case 11, preferably of aluminum material, has its rearmost end crimped or otherwise secured to a peripheral annular shoulder 12 at the rearward base portion 13 of a substantially cylindrical retainer 14. The cartridge case on assembly is loaded with an appropriate gas generating charge 15 such as propellant and black powder located forwardly of retainer 14 and utilized with a propellant actuated device or the like (not shown). Pressure gas from charge 15 ruptures any unsupportable adjacent wall of case 11, for example an end wall of the case upon assembly in an initiator or the like. Threadedly secured to the forwardmost internal surface of the retainer cylindrical sidewall is the forwardmost one of a pair of longitudinally spaced spool flange members 16, 17 that are integrally connected by hub portion 18. Spool flange 16 has a forwardly opening recess 19 in its outer face that contains igniter mix 20 for igniting the gas generating charge 15. A Pyrofuze foil disc 21 extends across the recess 19 and is suitably secured to the outer surface of flange 16 by an annular bead of vulcanized rubber 22. Spool flange 17 has a rearwardly opening recess 24 in its outerface that contains ignition mix 25 which is ignited by primer 26 centrally located in retainer base portion 13. A thin flammable cover 27 of tissue paper or the like extends across recess 24 and is appropriately secured to the outer surface of spool flange 17 by cellulose glue or the like. A burnable Pyrofuze delay wire 30, initially covered with braided fiberglass 31, is spirally wrapped along the spool hub portion 18 and stripped end portions of the wire 30 extends through passages in the corresponding spool flanges 16, 17 and are embedded in the igniter mix and ignition mix, respectively. Appropriately mounted heat shrinkable tubing connectors 33, 34 of silicone rubber material connect portions of the stripped wire ends to and insulate the same from the respective spool flanges 16, 17.

An O-ring seal 36 seated in an annular peripheral recess 37 provided in spool flange 17, precludes primer developed gas to blow by flange 17 or the ignition delay unit and cause a pre-ignition. The retainer base 13 and spool delay element are constructed or dimensioned to provide upon assembly, a cavity 38 therebetween as defined by the longitudinally spaced relationship between the spool delay element and retainer base 13. This aides in precluding primer overpressurization. Pressure relief passage 39 that is provided in retainer base 13 releases pressure build-up in cavity 38 during assembly of the spool in retainer 14. Passage 39 is subsequently hermetically sealed with vulcanized rubber 40 or its equivalent.

Various modifications, changes or alterations may be resorted to without departing from the scope of the invention as defined in the appended claims.

We claim:

1. In a gas generating device comprising, a cartridge case having a gas generating charge therein, a retainer secured in said case and having a rearward base portion containing a primer and a substantially cylindrical sidewall portion containing a delay ignition element, said delay ignition element including a spool having a pair of end flanges each containing a recess, ignition mix in one of said recesses and ignited by said primer, igniter mix in the other of said recesses for igniting said gas generating charge, and a burnable fuze delay wire spirally wound on said spool and having its end portions embedded in corresponding ones of said ignition mix and igniter mix, and an O-ring seal on an end flange of said spool forwardly adjacent said ignition mix.

2. The structure in accordance with claim 1 wherein a thin flammable cover overlies the rearward surface of said ignition mix recess, and a burnable fuze foil disc overlies the forward surface of said igniter mix recess.

3. The structure according to claim 2 wherein said spool and said retainer base portion are longitudinally spaced to define a cavity therebetween for precluding primer overpressurization, said retainer base portion having a rearward passage therethrough for releasing pressure build-up in said cavity during assembly, and a hermetic seal in said rearward passage.

* * * * *